US009555915B2

(12) United States Patent
Wettergreen

(10) Patent No.: US 9,555,915 B2
(45) Date of Patent: Jan. 31, 2017

(54) DISPENSER DISPLAY HAVING A PLURALITY OF INDEPENDENT DISPENSING BODIES

(71) Applicant: Joshua Wettergreen, Gilroy, CA (US)

(72) Inventor: Joshua Wettergreen, Gilroy, CA (US)

( * ) Notice: Subject to any disclaimer, the term of this patent is extended or adjusted under 35 U.S.C. 154(b) by 98 days.

(21) Appl. No.: 14/341,102

(22) Filed: Jul. 25, 2014

(65) Prior Publication Data

US 2015/0034672 A1 Feb. 5, 2015

Related U.S. Application Data

(60) Provisional application No. 61/861,201, filed on Aug. 1, 2013.

(51) Int. Cl.

| | |
|---|---|
| ***B67D 7/74*** | (2010.01) |
| ***B65D 1/32*** | (2006.01) |
| ***A47F 7/28*** | (2006.01) |
| ***A45D 33/02*** | (2006.01) |
| ***A45D 34/02*** | (2006.01) |
| *A45D 40/00* | (2006.01) |

(52) U.S. Cl.

CPC ..... *B65D 1/32* (2013.01); *A45D 33/02* (2013.01); *A45D 34/02* (2013.01); *A47F 7/286* (2013.01); *A45D 2040/0012* (2013.01)

(58) Field of Classification Search

CPC A45D 2040/0012; A45D 33/02; A45D 34/02; B65D 1/32; A47F 7/286

USPC ..... 222/142.3, 142.4, 212

See application file for complete search history.

(56) References Cited

U.S. PATENT DOCUMENTS

| | | | | | |
|---|---|---|---|---|---|
| 180,508 | A * | 8/1876 | Waudby | A47G 19/24 | 222/142.3 |
| 521,246 | A * | 6/1894 | Perry | B65D 1/32 | 222/215 |
| D91,555 | S * | 2/1934 | Dulany | 222/142.3 | |
| 2,898,007 | A * | 8/1959 | Gassaway | B65D 83/0033 | 222/212 |
| 3,674,183 | A * | 7/1972 | Venable | B65D 47/2031 | 222/212 |
| 4,072,249 | A * | 2/1978 | Ekenstam | A61M 5/282 | 222/107 |
| 5,454,492 | A * | 10/1995 | Hunter | B67D 3/0009 | 150/154 |
| 5,476,194 | A * | 12/1995 | Hippely | A45D 34/00 | 206/235 |
| 2004/0120753 | A1* | 6/2004 | Gieux | A45D 33/02 | 401/200 |
| 2011/0226813 | A1* | 9/2011 | Semersky | B65D 1/0223 | 222/186 |

* cited by examiner

*Primary Examiner* — Patrick M Buechner

(74) *Attorney, Agent, or Firm* — Donald R. Boys; Central Coast Patent Agency, Inc.

(57) ABSTRACT

A system for displaying and dispensing has a plurality of dispensers each having a hollow body formed with at least one wall of flexible material, and a dispensing opening through a wall of the body, the body providing a default internal volume, such that deforming the hollow body reduces the internal volume, increasing pressure within the internal volume, and a support structure to which the plurality of dispensers is joined, the support structure presenting the plurality of dispensers in a specific three-dimensional pattern.

10 Claims, 7 Drawing Sheets

DISPENSER DISPLAY HAVING A PLURALITY OF INDEPENDENT DISPENSING BODIES

CROSS REFERENCE TO RELATED DOCUMENTS

The present invention claims priority to Provisional Patent Application Ser. No. 61/861,201 filed on Aug. 1, 2013, and incorporates all of the disclosure of the priority application at least by reference.

BACKGROUND OF THE INVENTION

1. Field of the Invention

The present invention is in the field of display and dispenser products including aroma-based material dispensers and pertains particularly to methods and apparatus for displaying dispensers and dispensing a material.

2. Discussion of the State of the Art

In the field of dispenser products, there are many examples of material dispensers in the art such as spray bottles like perfume samplers and the like or apparatus such as sponges containing reservoirs for dispensing perfumed soap, etc. Typically these sampler apparatuses are loosely associated with a display area or marketing area selling the materials such as perfume and the like that may be sampled. Persons may walk away with such products or they may be lost while being moved or stored.

It has occurred to the inventor that if a plurality of material dispensers could be provided more economically with fewer moving parts and displayed in a fashion that is not only visually satisfying, but convenient for sampling, materials might be sampled more often, which might lead to better sales and better retention of the dispensers associated with the display.

Therefore, what is clearly needed is a material dispensing apparatus that displays a plurality of material dispensers as an accessible but secured group of economical dispensers made available for use by patrons.

BRIEF SUMMARY OF THE INVENTION

In one embodiment of the present invention a system for displaying and dispensing is provided, comprising a plurality of dispensers each having a hollow body formed with at least one wall of flexible material, and a dispensing opening through a wall of the body, the body providing a default internal volume, such that deforming the hollow body reduces the internal volume, increasing pressure within the internal volume, and a support structure to which the plurality of dispensers is joined, the support structure presenting the plurality of dispensers in a specific three-dimensional pattern.

In one embodiment the system further comprises a powder, liquid or gaseous material within the internal volume, such that deforming the hollow body causes ejection of the material through the dispensing opening as a powder, a spray, a mist, a gas, a liquid, or a vapor, depending upon the nature of the material. Also in one embodiment individual ones of the dispensers further comprise an introduction opening formed in the body, the introduction opening adapted to receive the powder, liquid or gaseous material from an introduction source. Also in one embodiment the introduction source is one of a syringe, a canister, a pressurized cartridge, or a reservoir with a pump.

In yet another embodiment of the system the dispensing opening includes a flexible member that closes the dispensing opening in the situation of equal pressure on each side of the opening, and allows material to pass in the situation of unequal pressure across the opening. In another embodiment the system further comprises a base plate or a ceiling mount plate connected to one end of the support structure. In still another embodiment the support structure comprises a plurality of tethers or cables joined to and supporting individual ones of the dispensers.

In one embodiment the tethers or cables are attached at one end to a hub supported either on a vertical support from the base plate, or from the ceiling mounting plate. Also in one embodiment the tethers or cables are extensible from the hub and retractable into the hub. Also in one embodiment the support structure comprises conduits joined to the dispensers at the introduction openings, such that the powder, liquid or gaseous material is introduced through the conduit structure from an external source.

In another embodiment individual ones of the dispensers further comprise graphic indicia. In another embodiment the hollow body holds a sponge-like material absorbing liquid introduced through the introduction opening. In still another embodiment the system further includes a reactive material within the hollow body, the reactive material reacting with introduced material to produce a dispensed material. And in one embodiment the dispensers are removably attached to the tethers or cables by snap fittings.

DETAILED DESCRIPTION OF THE INVENTION

In various embodiments described in enabling detail herein, the inventor provides an apparatus for dispensing a material. The present invention is described in enabling detail using the following examples, which may describe more than one relevant embodiment falling within the scope of the present invention.

Figure 1:
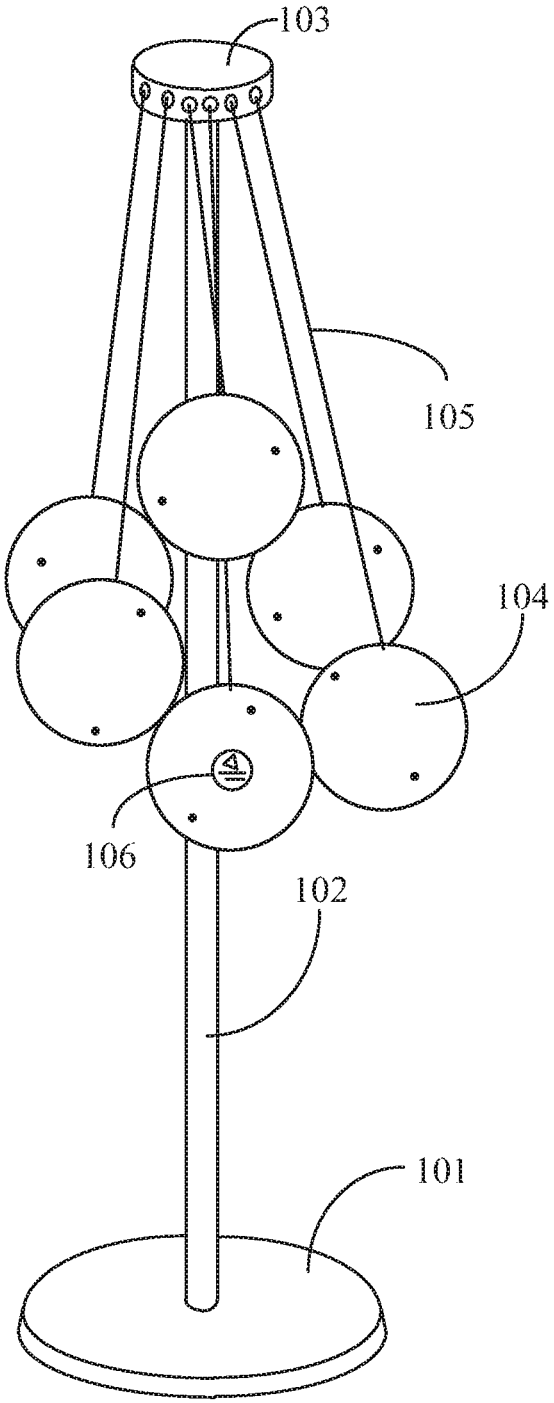
FIG. 1 is an elevation view of a dispenser apparatus assembled as a stand in an embodiment of the present invention.

FIG. 1 is an elevation view of a dispenser apparatus assembled as a stand in one embodiment of the present invention. In this embodiment a stand with a base plate 101 and a vertical support shaft 102 has a tether mechanism 103 connected to the shaft at the top. The tether mechanism may comprise cords, cables or rigid supports or conduits 105 that hold material dispensers also referred to as dispenser balls 104. There will typically be more than one material dispenser, and in some cases several material dispensers 104. In some embodiments the material dispensers may be in various colors, and there may be graphic indicia 106, text or pictures, and in some cases the indicia will identify material within the dispensers.

Base plate 101 may be a weighted plate and in one embodiment vertical shaft 102 may be some other vertical support without departing from the spirit and scope of the present invention. Shaft 102 may be a metal rod or tube that is male-threaded at both ends to support attachment to base plate 104 and to tether hub 103, both the base plate and the hub having a compatible female thread provided therein for the purpose.

In this embodiment each ball (material dispenser) 104 may be supported by a tether 105 at a different height relative to other retained balls and the floor upon which base plate 104 may rest. Tethers 105 may, in one embodiment, be extended or pulled out from or be caused to retract back into tether mechanism 103. In this embodiment the tether mechanism may spool each tether, and in some embodiments the mechanism is enabled to hold a position where a user may release or otherwise disconnect a dispenser ball from its tether. In FIG. 1 individual dispenser balls are shown extended or retracted to different positions. Dispenser ball 104 may be molded, using a relatively resilient polymer or rubber material, in a shape other than a ball or sphere without departing from the spirit and scope of the present invention. A material dispenser such as dispenser ball 104 may take the form of a recognizable object such as a piece of fruit like an orange, banana, or essentially any recognizable object. Other shapes may be adopted as well according to industry type, display product type, and other user preferences.

Figure 2:
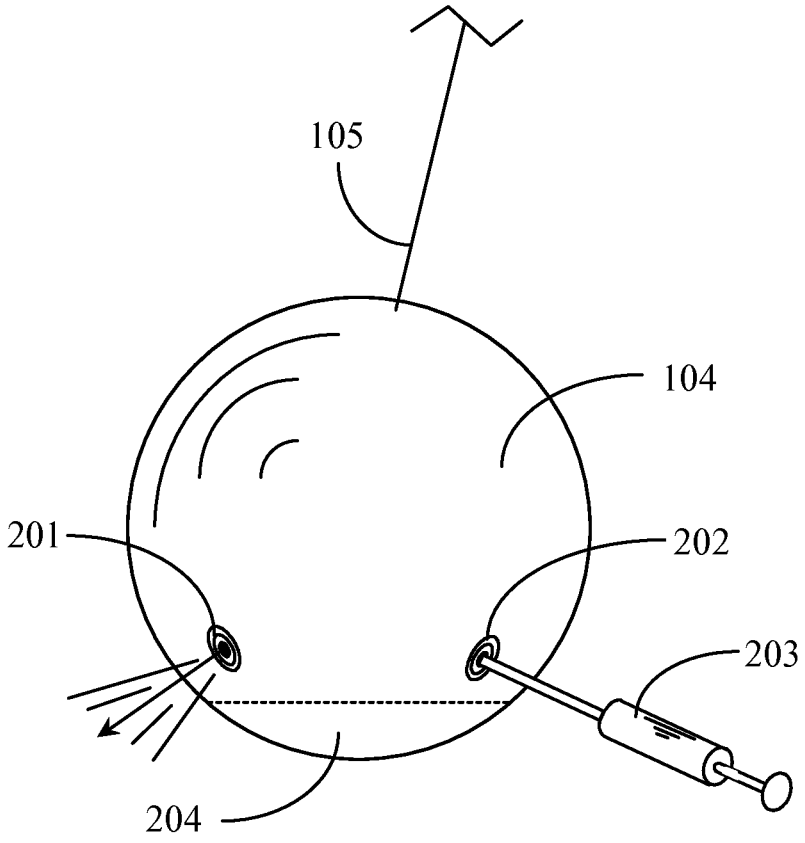
FIG. 2 illustrates a single material dispenser in an embodiment of the invention.

FIG. 2 illustrates a single material dispenser 104 in an embodiment of the invention. Material dispensers or dispenser balls 104 may be used to dispense a spray, a mist or a vapor of a substance like, for example, cologne or perfume, depending at least in part on the nature of the material that may be in the dispenser. In one embodiment dispenser balls 104 may be adapted to dispense a powder, a liquid, or a gas without departing from the spirit and scope of the invention.

In this and some other embodiments dispenser balls 104 are made or molded of a polymer material that retains it's shape as a hollow sphere if not deformed intentionally by external pressure, but may be deformed to a lesser volume by, for example squeezing the ball. Balls may be of various sizes in one embodiment, or all having the same diameter, and may vary widely in diameter or dimensions of other shapes over different embodiments of the invention.

In the embodiment described here each ball 104 may have at least one dispenser opening 201. Dispenser opening may be a valve, or passage, which may be enabled as a one-way orifice to spray or otherwise dispense as a result of pressure or force applied to the dispenser ball 104 by a user, or even by a mechanism manipulated by a user. One method of applying force may be physically squeezing the ball by a user's hand. Ball 104 in this embodiment also has at least one fill opening 202 with one-way passage into the ball. Opening 202 may be a unidirectional input valve adapted to accept a material for dispensing that is introduced into the inner volume of the ball via opening 202. The valve's unidirectional characteristic may prevent material from dispensing through or otherwise exiting opening 202 when the ball is physically deformed or otherwise subjected to pressure or force to dispense the material.

In one embodiment dispenser ball 104 may be recharged by, for example, a syringe 203 inserted into opening 202. In some embodiments instead of a syringe, a pressurized canister, a pressurized cartridge, or a reservoir and pump might be used to charge a dispenser ball. Different methods of material introduction may depend at least in part of the exact material being dispensed. In some cases material in the dispenser ball may be a powder (solid), a liquid, a gas, or a vapor. In one embodiment a liquid 204 may be injected up to a fill line. The liquid will support, by evaporation, a vapor over the liquid, and it will be the vapor that is dispensed when the ball is deformed, assuming of course that the dispenser opening is above the fill line. In other embodiments the liquid fill may be above dispenser opening 201, and deformation will dispense a spray of the liquid. In yet other embodiments the material may be gaseous, and injected as a gas, so gas will be dispensed. In some embodiments tethers may be conduits, and material may be introduced to dispenser balls through the tethers from one or more reservoirs. An example is described below with reference to FIG. 8.

Dispense and fill openings may be variously implemented in a ball 104 relative to position of attachment of tether 105, and in some cases there may be different numbers of such openings on a single material dispenser ball. Dispenser openings such as opening 201 may be a simple bi-directional opening without departing from the spirit and scope of the present invention. In a variation of this embodiment there may be a plurality of dispenser openings 201 on dispenser ball 104 that may be small enough in diameter to be restrictive to pass-through of dispensed material but less restrictive when pressure such as squeezing is applied to dispenser ball 104.

In the embodiment described immediately above the resiliency of the dispenser ball causes it to reassume original shape after being temporarily deformed by squeezing. During this process (re-expansion) air may pass into the ball through the dispenser passages. Such a design consideration may be dependant on the material dispensed, for example, a fine powder may be dispensed through the multiple dispense openings 201 repeatedly by continued squeeze and release of the dispenser ball. In some embodiments a separate air ingress opening with one-way passage into the ball may be provided on an upper portion of the dispenser ball.

Figure 3:
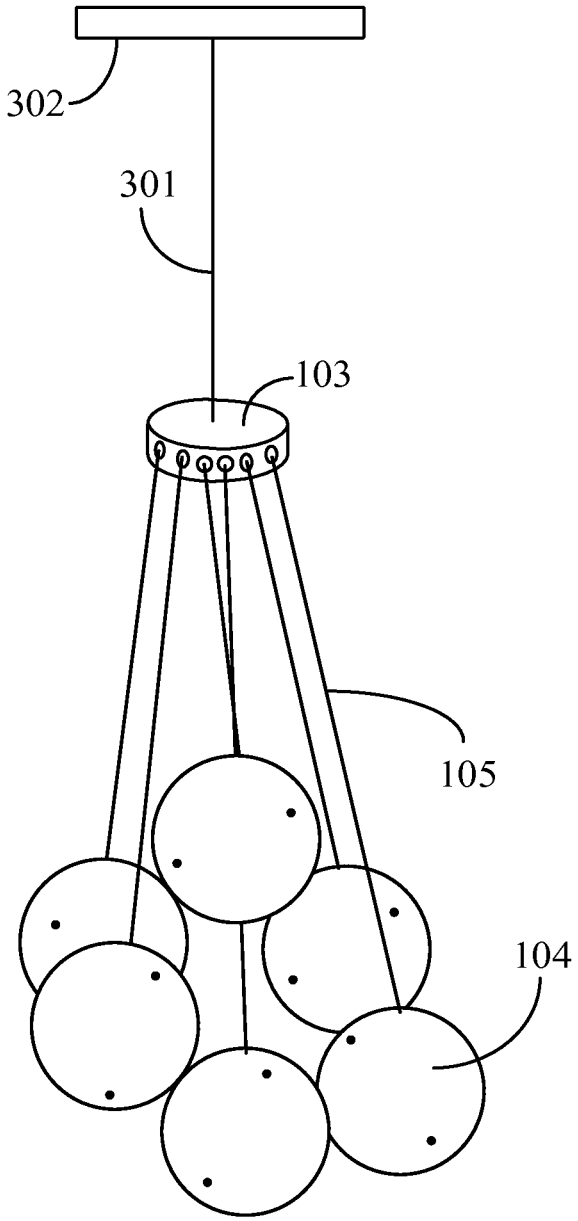
FIG. 3 is an elevation view of a dispenser apparatus assembled as a hanging apparatus according to an alternative embodiment of the invention.

FIG. 3 is an elevation view of a dispenser apparatus assembled as a hanging apparatus according to an alternative embodiment of the invention. In this particular configuration tether mechanism 103 is suspended from a ceiling or other overhead structure by mounting the assembly to the overhead structure using a ceiling plate 302. In this embodiment the vertical structure may be a cable or cord 301 rather than a shaft or tubular structure depicted in FIG. 1 as shaft 102. Tether mechanism 103 may enable tethers to be pulled out from it or to be caused to retract into it. This feature is optional and not a limitation for practicing the invention. In some embodiments element 103 may be a passive element to attach tethers.

Figure 4:
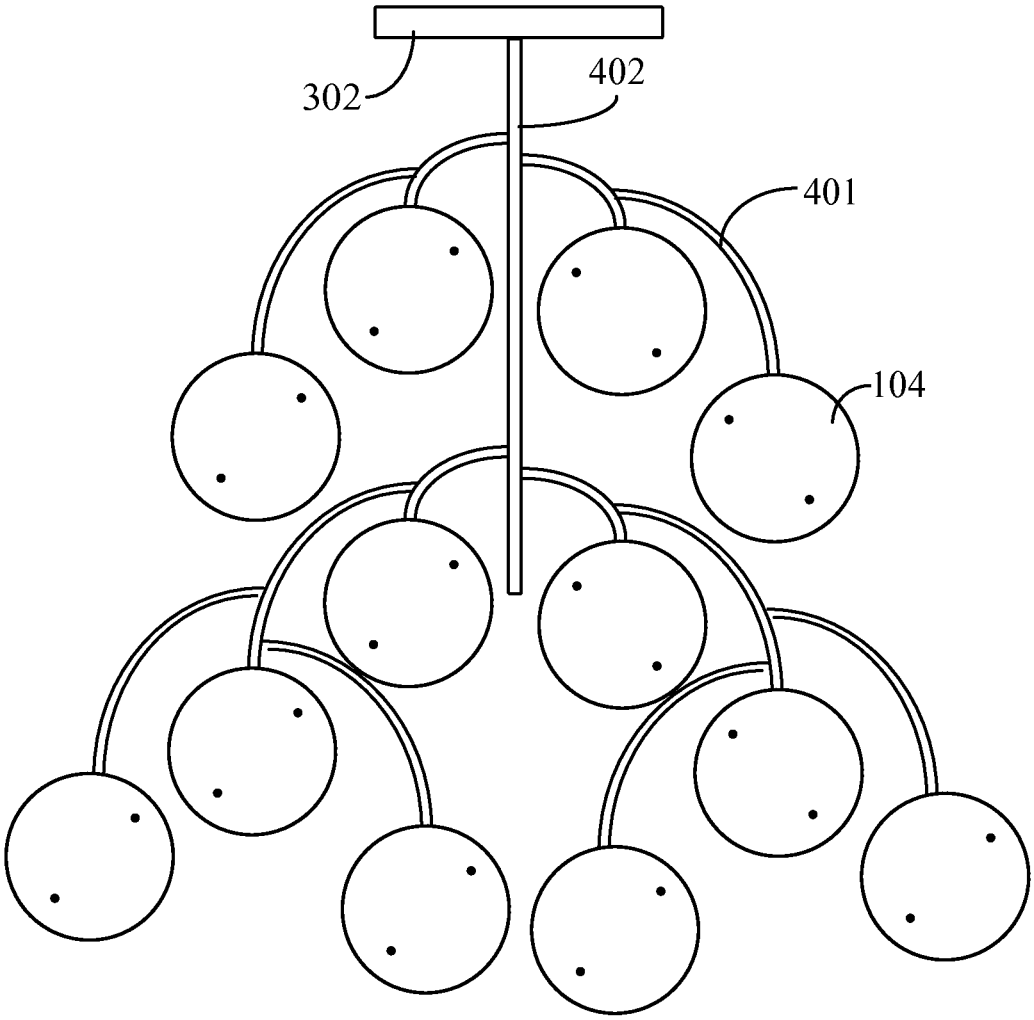
FIG. 4 is an elevation view of a dispenser apparatus assembled as a tree structure in yet another alternative embodiment.

FIG. 4 is an elevation view of a dispenser apparatus assembled as a tree structure in yet another alternative embodiment. In this example dispenser balls 104 are supported on a tree-like structure comprising a ceiling mount 302 a vertical support shaft 402, and a plurality of elongate members 401, each elongate member 401 connected, at one end, to a material dispenser ball 104 and at the opposite end to vertical support shaft 402, or to other elongate members eventually connection back to the shaft. In this arrangement the structure supporting the balls is branched in a way that suggests, for example a bunch of grapes. This structure may be suspended from above or from a pedestal support like in FIG. 1 as well. The members 401 may be rigid, supporting a particular shape to the assembly, or may be semi-rigid, un which case gravity will affect the shape, or even less rigid, such that the balls will hang loosely together.

In one embodiment elongate members 401 are solid arcuate tubes, wires, or rods and project downward. In another embodiment elongate members 401 may be flex links or flex hoses. In one embodiment members 401 are arcuate tubes or solid rods welded together and to shaft 402. In one embodiment shaft 402 is rotatably connected to ceiling plate 302 such that the lower assemble may rotate about the shaft. In one embodiment, members 401 may be hollow tubes and dispenser balls 104 are held against the ends of the members by a stretch cord extending into each tube and anchored. In such an embodiment a user may pull the dispenser ball away from the assembly for use and then release it when done. The stretch cord pulls the ball back to the end of the tube.

Dispenser balls 104, as described above, may carry different materials of different sorts in one apparatus, and in some cases the balls themselves may be different shapes and different colors, and may represent different sorts of objects. For example, balls 104 may be realized as articles of fruit, such as blueberries, raspberries, strawberries, and other shapes as well.

Figure 5:
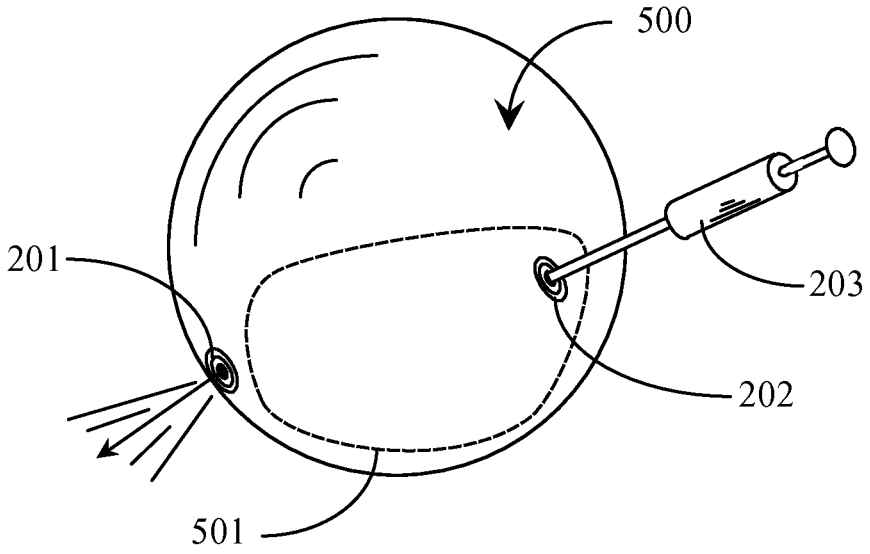
FIG. 5 is an elevation view of a material dispenser formed about a sponge like material in one embodiment.

FIG. 5 is an elevation view of a material dispenser 500 formed about a sponge like material 501 in one embodiment. Dispenser ball 500 is analogous to ball 104 previously depicted accept that it is formed about and encapsulates sponge-like material 501 (depicted as a broken boundary). This may be achieved during a molding process. Input or introduction valve 202 may accept syringe 203 filled with a liquid material for dispensing. Sponge 501 may take up the liquid, retaining the liquid within the sponge for repeated use. A user squeezing ball 104 may dispense aroma or vapor from within ball 104 through dispense opening or valve 201.

Figure 6:
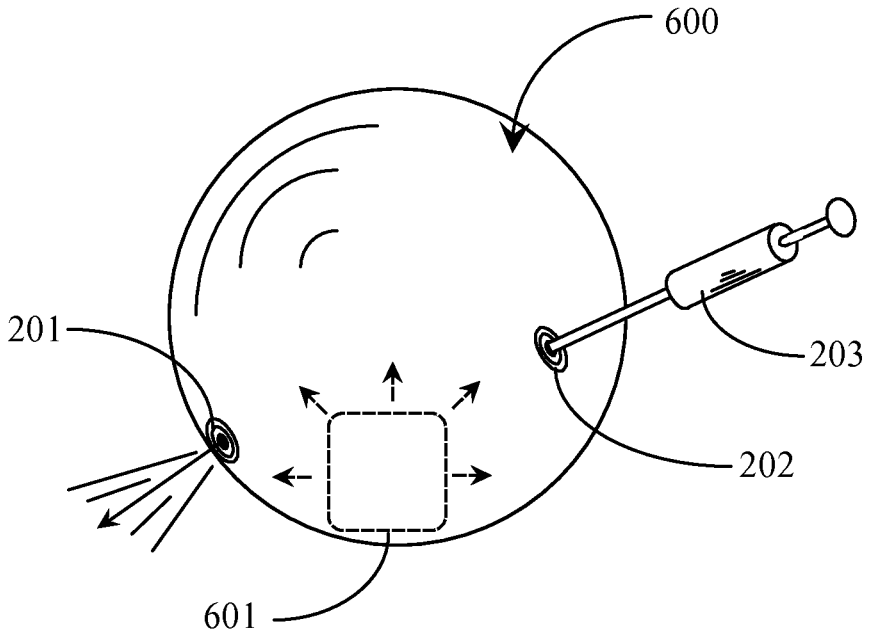
FIG. 6 is an elevation view of a material dispenser formed about a reactive material in one embodiment.

FIG. 6 is an elevation view of a material dispenser 600 formed about a reactive material 601 in one embodiment. Dispenser ball 600 is analogous to dispenser ball 104 previously depicted except for that it is formed about and encapsulates reactive material 601 (depicted as a broken boundary with emanating arrow pattern). This may be achieved during a molding process. Input or introduction valve 202 may accept a material from syringe 203 or from another input vessel such as a pressurized gas cartridge or spray canister for example. The input material may be selected for reaction with reactive material 601 to produce a desired aroma, vapor, fragrance, or other dispensed material.

Material 601 does not have to be reactive as the material introduced into the ball may be reactive. The material used to create a reaction may vary depending on application. To illustrate one possible use case, reactive material 601 may be a menthol-based cube or block activated by warm moist air or steam. In a variation of this embodiment a slow reaction may be initiated where vapor or gas released as the desired byproduct of the reaction continuously expands within the dispenser ball increasing pressure until some of the material automatically dispenses or escapes through one or more dispense passages. It is important to note herein that encapsulating a sponge or reactive (solid) material within the dispenser ball is not a requirement in practice of the present invention.

Figure 7:
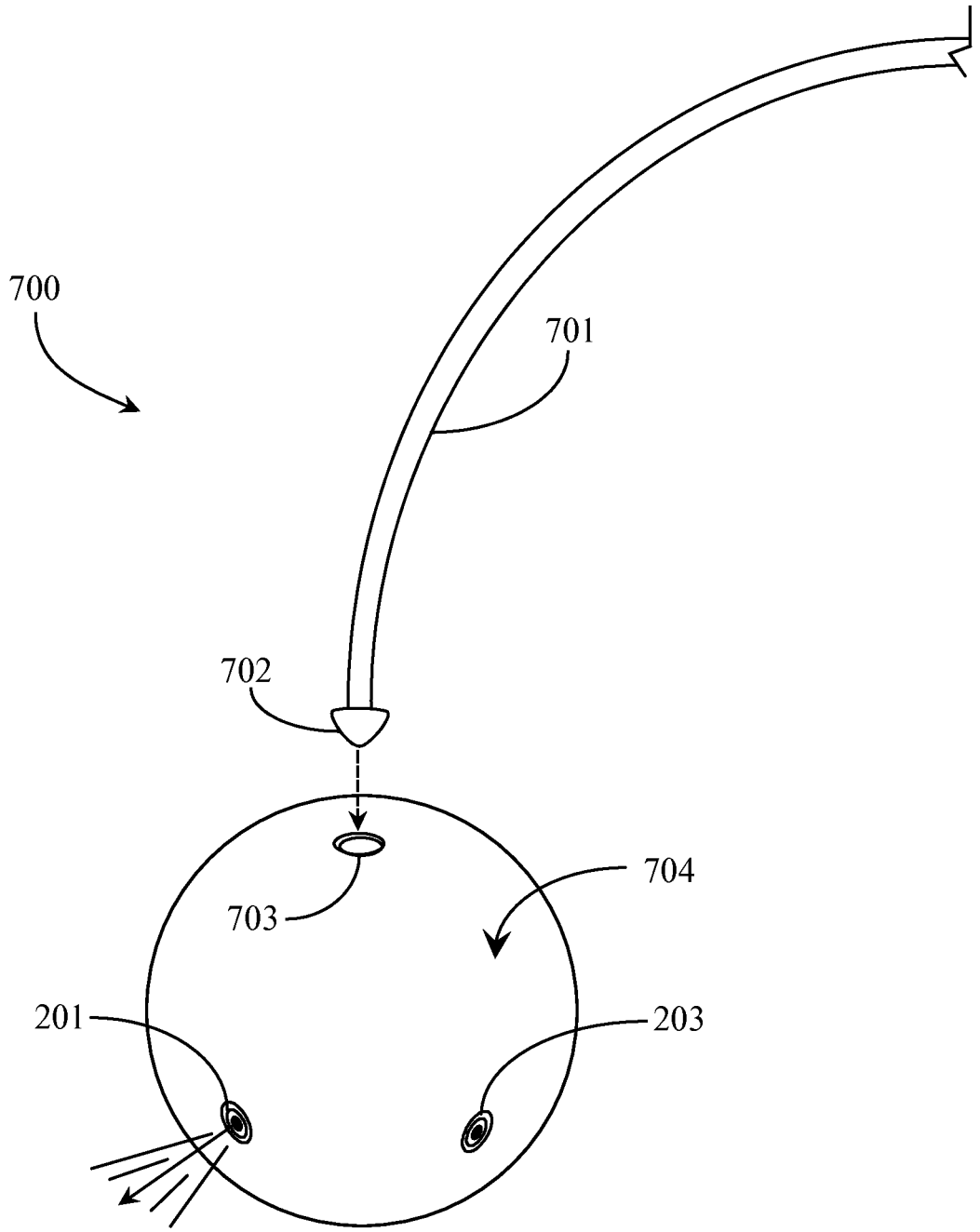
FIG. 7 is a partial view of a material dispenser apparatus having a modular material dispenser connectable thereto in one embodiment.

FIG. 7 is a partial view of a material dispenser apparatus 700 having a modular material dispenser 704 connectable thereto in one embodiment. Dispenser ball 704 is analogous to dispenser ball 104 depicted previously accept for that it has an opening 703 placed there through for accepting a cone-shaped or ball-shaped snap head 702 formed on the connecting end of an elongate member 701. Opening 703 in one embodiment does not extend into the interior cavity of the ball. The inside diameter of opening 703 is small enough to be temporarily stretched outward by insertion of snap head 702. Once the snap head is pressed in through the opening, the diameter of the opening shrinks back due to material resiliency and retains the ball on the end of the elongate member. In such an embodiment, the ball may be easily removed for use and for recharging with materials for dispensing.

Figure 8:
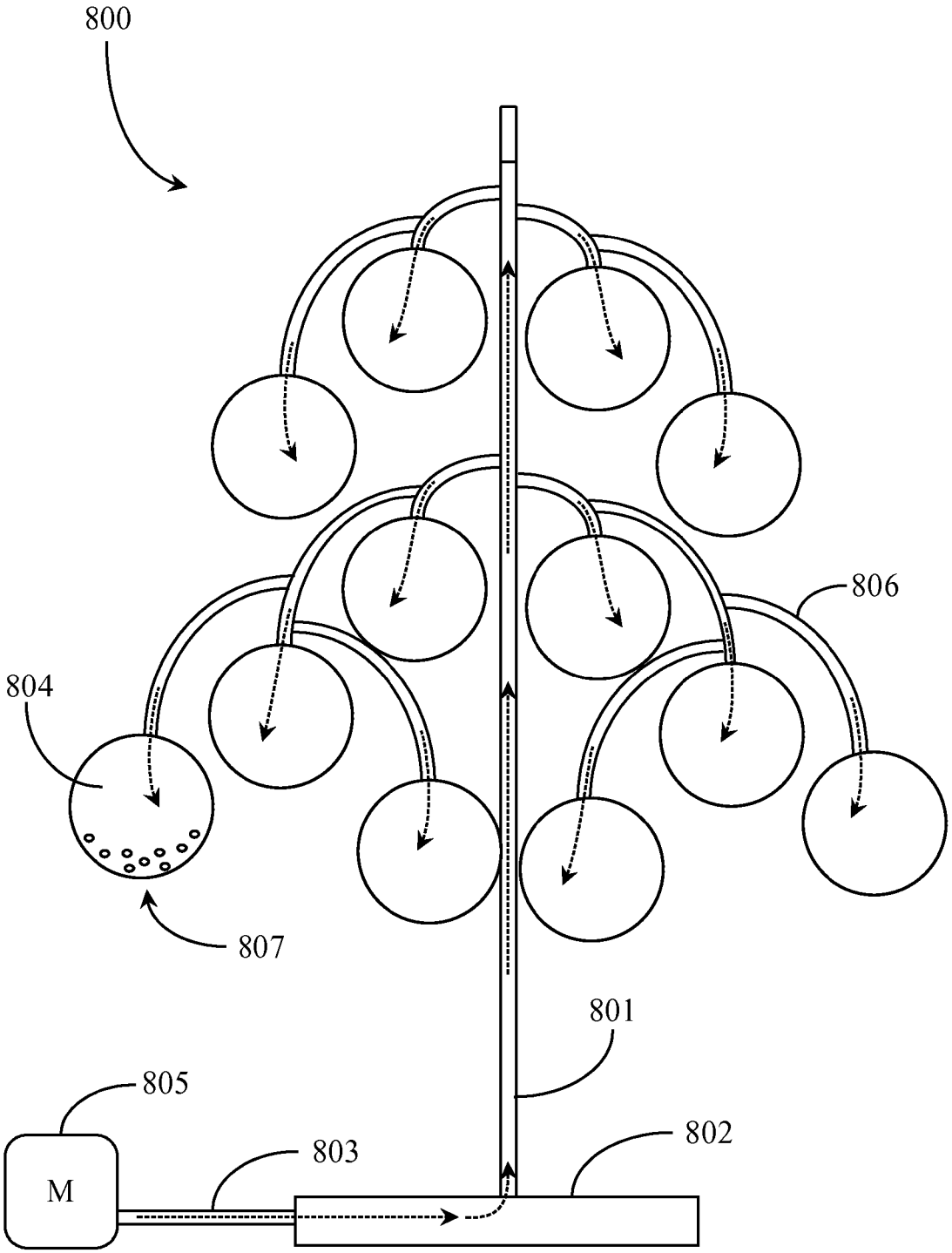
FIG. 8 is an elevation view of a dispenser apparatus according to another alternative embodiment supporting a single material communication pathway to each material dispenser.

FIG. 8 is an elevation view of a dispenser apparatus 800 according to another alternative embodiment supporting a single material communication pathway to each material dispenser. Dispenser apparatus 800 resembles the tree-like structure mentioned in description of FIG. 4. The structure involves a base plate 802, a vertical support tube 801 connected to the base plate, and a plurality of elongate members 806, each member connected at one end to a material dispenser 804 and at the opposite end to tube 801 or another member 806 in the tree.

In one embodiment the elongate members are arcuate tubes open at both ends such that connection from one tube to another and to vertical tube 801 form a continuous tubular material pathway that may be used to charge all of the material dispenser balls 804 simultaneously. In this embodiment dispenser balls 804 may be connected to respective tube ends via the unidirectional input valve or opening provided for the purpose.

Tube 801 may be threaded into base plate 802 and may communicate with a horizontal pathway (conduit) 803 provided through the plate and connecting to a material source (M) 805. Material source 805 may be an electronic device, a pressurized container, a pump, or some other delivery utility capable of distributing material into each connected dispenser ball 804 via base plate 802, into and through tube 801 in the direction of the arrows, into the tubular elongate members, and into each dispenser ball. Tube 801 may be capped above the level of the connected member tubes. In one embodiment charging dispenser balls 804 with material from source 805 may be automated and may happen periodically. In one embodiment different materials may be rotated through presentation by selecting a next material at each charge period. IN another embodiment there may be more than one source 805, and there may be separate passages though the tubular structure.

Tubes may be threaded and may be threaded onto the vertical tube and to other member tubes. Tubes may be welded together and to the vertical tube at specific openings created for enabling the pathway through the structure once welded tight. In this example, ball 804 has multiple or a plurality of dispense passages 807 provided through the wall of the dispenser. In one embodiment the material used to fabricate ball 804 is porous enough to dispense material through natural openings generic to the level of porosity in the material.

In various embodiments, the dispensing apparatuses according to embodiments of the invention may dispense materials such as air fresheners, deodorants, and other substances as well. In one embodiment they may dispense a bacterial agent. Such apparatus may be placed in kitchens, bathrooms, hospitals, bedrooms, offices and other places as well.

In another use case, dispensing apparatuses may be utilized in retail stores, or in marketing environments, serving as displays, that may in many embodiments be working models to demonstrate just what may be done with the apparatus.

It will also be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the apparatus may be implemented within the scope of the invention. The invention is limited only by the breadth of the claims below.

The invention claimed is:

1. A system for displaying and dispensing, comprising:

a plurality of dispensers each having a hollow body formed with at least one wall of flexible material, and a dispensing opening through a wall of the body, the body providing a default internal volume, such that deforming the hollow body reduces the internal volume, increasing pressure within the internal volume; and a support structure, having a base plate or a ceiling mount plate and a plurality of tethers or cables joined to and supporting individual ones of the dispensers, the tethers or cables attached at one end to a hub supported on either a vertical support from the base plate or from the ceiling mounting plate, with the tethers or cables extensible from and retractable into the hub, the support structure presenting the plurality of dispensers in a specific three-dimensional pattern.

2. A system for displaying and dispensing, comprising:

a plurality of dispensers each having a hollow body formed with at least one wall of flexible material, a dispensing opening through a wall of the body, the body providing a default internal volume, such that deforming the hollow body reduces the internal volume, increasing pressure within the internal volume, and an introduction opening formed in the body, the introduction opening adapted to receive the powder, liquid or gaseous material from an introduction source; and a support structure to which the plurality of dispensers is joined, the support structure having conduits joined to the dispensers at the introduction openings, such that the powder, liquid or gaseous material is introduced through the conduit structure from an external source, the support structure presenting the plurality of dispensers in a specific three-dimensional pattern.

3. The system of claim 2 wherein the introduction source is one of a syringe, a canister, a pressurized cartridge, or a reservoir with a pump.

4. The system of claim 2 wherein the dispensing opening includes a flexible member that closes the dispensing opening in the situation of equal pressure on each side of the opening, and allows material to pass in the situation of unequal pressure across the opening.

5. The system of claim 1 wherein the dispensers are removably attached to the tethers or cables by snap fittings.

6. The system of claim 2 wherein individual ones of the dispensers further comprise graphic indicia.

7. The system of claim 6 wherein the graphic indicia identify material in the dispenser.

8. The system of claim 2 further comprising a powder, liquid or gaseous material within the internal volume, such that deforming the hollow body causes ejection of the material through the dispensing opening as a powder, a spray, a mist, a gas, a liquid, or a vapor, depending upon the nature of the material.

9. The system of claim 2 further including a reactive material within the hollow body, the reactive material reacting with introduced material to produce a dispensed material.

10. A system for displaying and dispensing, comprising:

a plurality of dispensers each having a hollow body formed with at least one wall of flexible material, a dispensing opening through a wall of the body, an introduction opening formed in the body, the introduction opening adapted to receive powder, liquid or gaseous material from an introduction source, and a sponge-like material within the hollow body absorbing liquid introduced through the introduction opening, the body providing a default internal volume, such that deforming the hollow body reduces the internal volume, increasing pressure within the internal volume; and a support structure to which the plurality of dispensers is joined, the support structure presenting the plurality of dispensers in a specific three-dimensional pattern.

* * * * *